US006837275B2

(12) United States Patent
Josef et al.

(10) Patent No.: US 6,837,275 B2
(45) Date of Patent: Jan. 4, 2005

(54) AIR CHANNEL DRYER FABRIC

(75) Inventors: Michael J. Josef, Clifton Park, NY (US); Rick Barbery, Columbia, SC (US)

(73) Assignee: Albany International Corp., Albany, NY (US)

( * ) Notice: Subject to any disclaimer, the term of this patent is extended or adjusted under 35 U.S.C. 154(b) by 229 days.

(21) Appl. No.: 10/289,968

(22) Filed: Nov. 7, 2002

(65) Prior Publication Data

US 2004/0089363 A1 May 13, 2004

(51) Int. Cl.[7] ..... D03D 15/00

(52) U.S. Cl. ..... 139/383 A; 139/383 AA; 139/426 R; 442/217

(58) Field of Search ..... 139/383 A, 383 AA, 139/426 R; 442/217; 162/348

(56) References Cited

U.S. PATENT DOCUMENTS

| | | | | |
|---|---|---|---|---|
| 4,283,454 A | | 8/1981 | Buchanan | |
| 5,169,499 A | | 12/1992 | Eagles et al. | |
| 5,503,196 A | | 4/1996 | Josef et al. | |
| 6,276,402 B1 | * | 8/2001 | Herring | 139/383 A |
| 6,354,335 B1 | * | 3/2002 | Taipale et al. | 139/383 A |
| 6,413,377 B1 | * | 7/2002 | Wright | 139/383 A |
| 6,427,728 B1 | * | 8/2002 | Maguire et al. | 139/383 A |
| 6,585,006 B1 | * | 7/2003 | Wilson et al. | 139/383 A |
| 6,649,026 B2 | * | 11/2003 | Lamb | 162/348 |
| 6,745,797 B2 | * | 6/2004 | Troughton | 139/383 A |
| 6,763,855 B2 | * | 7/2004 | Rougvie | 139/383 A |

FOREIGN PATENT DOCUMENTS

GB 2 292 755 A 3/1996

* cited by examiner

*Primary Examiner*—John J. Calvert
*Assistant Examiner*—Robert H. Muromoto, Jr.
(74) *Attorney, Agent, or Firm*—Frommer Lawrence & Haug LLP; Ronald R. Santucci

(57) ABSTRACT

A papermaker's fabric includes first and second layers of cross-machine-direction (CD) yarns and a plurality of machine-direction (MD) yarns interwoven therewith and arranged in groups each having a first, two second, and two third MD yarns. The first MD yarn binds with two CD yarns of the first layer and with two CD yarns of the second layer. The second MD yarns bind with only one CD yarn of the first layer and floats over at least two consecutive CD yarns of the second layer. The third MD yarns bind with only one CD yarn of the first layer and floats over at least two consecutive CD yarns of the second layer. The second MD yarns are offset from the third MD yarns in a direction parallel to the MD yarns. The first MD yarn is between the two second MD yarns which are between the third MD yarns so as to form a continuous air channel.

22 Claims, 8 Drawing Sheets

AIR CHANNEL DRYER FABRIC

BACKGROUND OF THE INVENTION

Field of the Invention

The present invention relates to the papermaking arts. More specifically, the present invention is a papermaker's or dryer fabric for use on the dryer section of a paper machine, such as on a single-run dryer section.

During the papermaking process, a fibrous web is formed by depositing a fibrous slurry on a forming fabric in the forming section of a paper machine. A large amount of water drains from the slurry through the forming fabric, leaving the fibrous web on the surface thereof.

The newly formed web proceeds from the forming section to a press section, which includes a series of press nips. The fibrous web passes through the press nips supported by a press fabric, or, as is often the case, between two press fabrics. In the press nips, the fibrous web is subjected to compressive forces which squeeze water therefrom. This water is accepted by the press fabric or fabrics and, ideally, does not return to the web.

The web, by now a sheet, finally proceeds to a dryer section, which includes at least one series of rotatable dryer drums or cylinders which are heated from within by steam. The sheet is directed in a serpentine path sequentially around each in the series of drums by one or more dryer fabrics, which hold it closely against the surfaces of the drums. The heated drums reduce the water content of the sheet to a desirable level through evaporation.

In a dryer section, the dryer cylinders may be arranged in a top and a bottom row or tier. Those in the bottom tier may be staggered relative to those in the top tier, rather than being in a strict vertical relationship. As the sheet proceeds-through the dryer section, it may pass alternately between the top and bottom tiers as it passes first around a dryer cylinder in one of the two tiers, then around a dryer cylinder in the other tier, and so on sequentially through the dryer section.

As shown in FIG. 5, in dryer sections, the top and bottom tiers of dryer cylinders may each be clothed with a separate dryer fabric 99. In such a situation, paper sheet 98 being dried passes unsupported across the space, or "pocket", between each dryer cylinder and the next dryer cylinder on the other tier.

In a single tier dryer section, a single row of cylinders along with a number of turning rolls may be used. The turning rolls may be solid or vented.

In order to increase production rates and to minimize disturbance to the sheet, single-run dryer sections are used to transport the sheet being dried at high speeds. In a single-run dryer section, such as that shown in FIG. 8, a paper sheet 198 is transported by use of a single dryer fabric 199 follows a serpentine path sequentially about dryer cylinders 200 in the top and bottom tiers.

It will be appreciated that, in a single-run dryer section, the dryer fabric holds the paper sheet being dried directly against the dryer cylinders in one of the two tiers, typically the top tier, but carries it around the dryer cylinders in the bottom tier. The fabric return run is above the top dryer cylinders. On the other hand, some single-run dryer sections have the opposite configuration in which the dryer fabric holds the paper sheet directly against the dryer cylinders in the bottom tier, but carries it around the top cylinders. In this case, the fabric return run is below the bottom tier of cylinders. In either case, a compression wedge is formed by air carried along by the backside surface of the moving dryer fabric in the narrowing space where the moving dryer fabric approaches a dryer cylinder. The resulting increase in air, pressure in the compression wedge causes air to flow outwardly through the dryer fabric. This air flow, in turn, forces the paper sheet away from the surface of the dryer fabric, a phenomenon known as "drop off". "Drop off" can reduce the quality of the paper product being manufactured by causing edge cracks. "Drop off" can also reduce machine efficiency if it leads to sheet breaks.

Many paper mills have addressed this problem by machining grooves into the dryer cylinders of the lower tier and/or rolls or by adding a vacuum source to the dryer rolls. Both of these expedients allow the air otherwise trapped in the compression wedge to be removed without passing through the dryer fabric, although both are expensive.

The present invention provides a solution to this problem in the form of a dryer fabric having void volume on at least one of its surfaces, that is on its back side surface which does not come into contact with the paper web and/or on its front side surface which does come into contact with the paper web. The void volume gives the air carried into the compression wedge somewhere to go other than through the fabric.

SUMMARY OF THE INVENTION

Accordingly, the present invention is a dryer fabric, although it may find application in any of the forming, press and dryer sections of a paper machine.

The papermaker's fabric includes a first layer and a second layer of cross-machine-direction (CD) yarns and a plurality of machine-direction (MD) yarns arranged in groups each having a first MD yarn, two second MD yarns, and two third MD yarns. The first MD yarn in each group is interwoven with CD yarns of the first and second layers in a duplex weave, binding with two CD yarns of the first layer and with two CD yarns of the second layer when interweaving therewith within a repeat pattern. The second MD yarns in each group are also interwoven with CD yarns of first and second layers in a duplex weave, binding with only one CD yarn of the first layer when interweaving therewith and floating over at least two consecutive CD yarns of the second layer when interweaving therewith within the repeat pattern. The third MD yarns in each group are also interwoven with CD yarns of the first and second layers in a duplex weave, binding with only one CD yarn of the first layer when interweaving therewith and floating over at least two consecutive CD yarns of the second layer when interweaving therewith within the repeat pattern. The second MD yarns are offset from the third MD yarns in a direction parallel to the MD yarns. The first MD yarn is between two second MD yarns which arc between the two third MD yarns in each group. As such, in each group, a continuous air channel is formed by the first MD yarn between the second MD yarns.

Each group may further include a fourth MD yarn which is interwoven with the CD yarns of the first and second layers in a duplex weave such that the fourth MD yarn binds with two CD yarns of the first layer and with two CD yarns of the second layer when interweaving therewith within a repeat pattern. The fourth MD yarn may be offset from the first MD yarn in the direction parallel to the MD yarns. Additionally, the fourth MD yarn in each group is between one of the third MD yarns thereof and one of the third MD yarns of an adjacent group, whereby a second continuous air channel may be formed in each group.

The fabric may be disposed on the dryer section in endless form, such that the continuous air channels reside on the back-side (or inner) surface and/or the front side surface thereof. The continuous air channels provide void volume for air carried into the compression wedge formed between the fabric and a dryer cylinder when the fabric is used on a dryer section such as a single-run dryer section.

The present invention will now be described in more complete detail with frequent reference being made to the drawing figures, which are identified below.

DETAILED DESCRIPTION OF THE PREFERRED EMBODIMENTS

Figure 1:
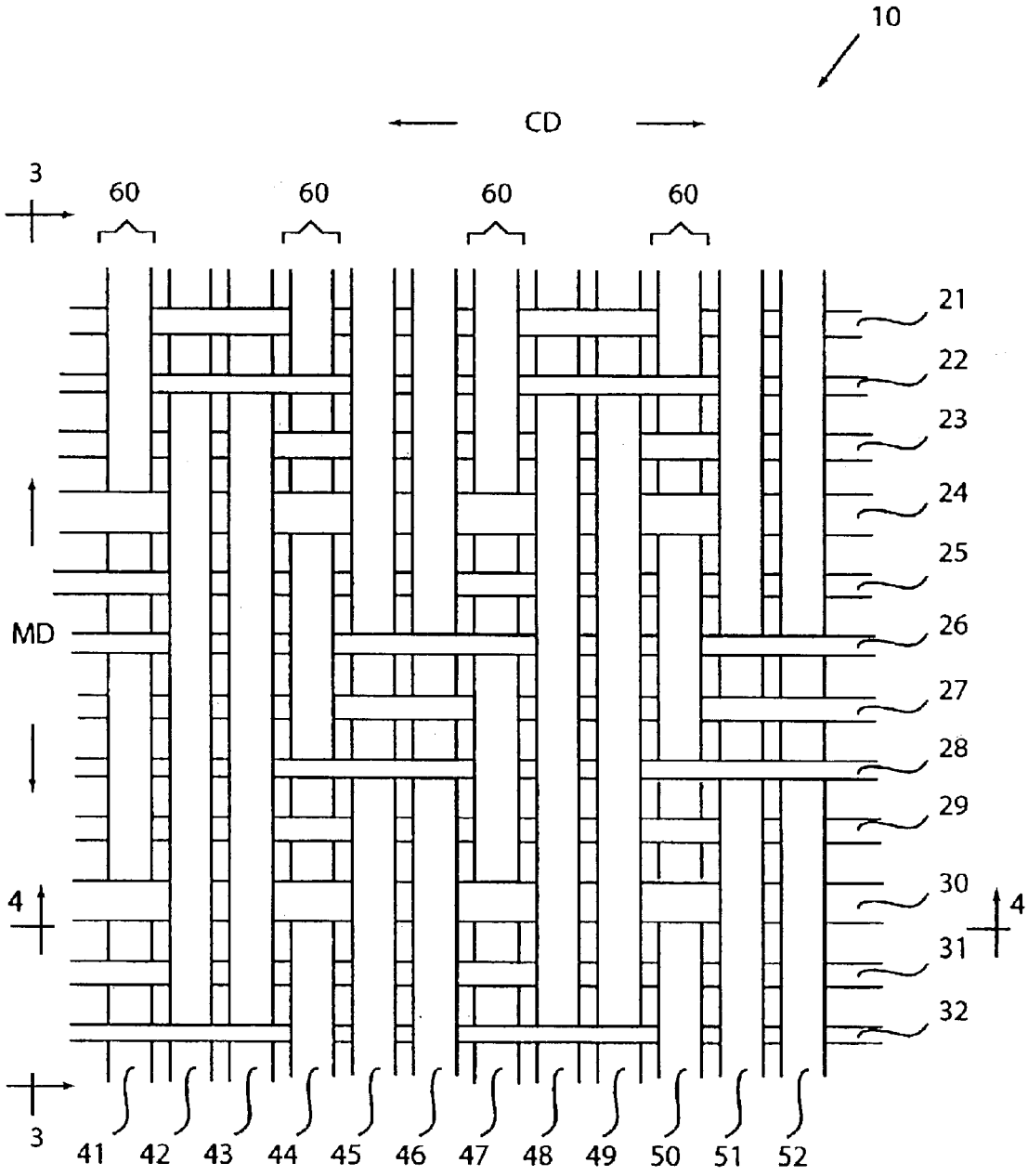
FIG. 1 is a plan view of a surface of a papermaker's fabric according to an embodiment of the present invention.

With reference now to these figures, FIG. 1 is a plan view of a surface 12 of the papermaker's fabric 10 according to an embodiment of the present invention. In FIG. 1, the machine direction (MD) and cross-machine direction (CD) are as indicated. The spacing between the yarns of the papermaker's fabric 10 in this and other figures is exaggerated for the sake of clarity. FIG. 1 shows two repeats of the weave pattern side by side one another.

Figure 3A:
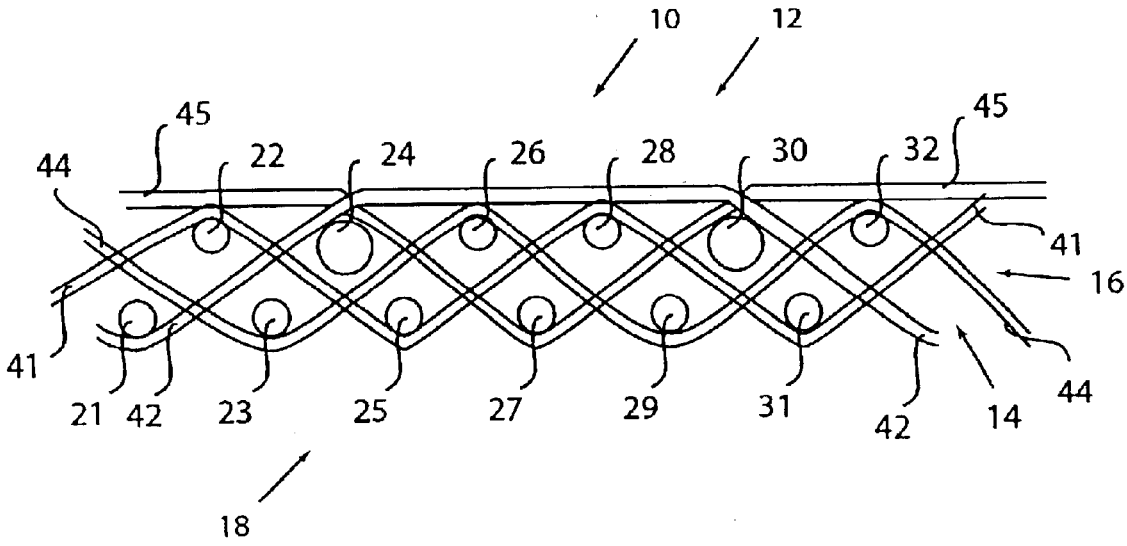
FIG. 3A is a cross-sectional view taken in the warpwise direction as indicated by line 3—3 in FIG. 1.

FIG. 3A is a cross-sectional view, taken as indicated by line 3—3 in FIG. 1. It will be observed that fabric 10 includes two layers of CD yarns. As fabric 10 may be flat woven and subsequently joined into endless form with a seam, the CD yarns are weft, or filling, yarns in the process by which fabric 10 is produced. A first layer 14 of CD yarns includes CD yarns 21,23,25,27,29,31, while a second layer 16 of CD yarns includes CD yarns 22,24,26,28,30,32. As is apparent in FIGS. 1 and 3A, the CD yarns in the two layers 14,16 are not in vertically stacked positions. Rather they alternate with one another in machine direction of the fabric 10, so that both layers are visible in the view presented in FIG. 1. In reality, CD yarns 21,23,25,27,29,31 of the first layer 14 may barely be visible on the surface 12 of the actual fabric 10 as the spacing between the yarns is quite small.

Figure 4:
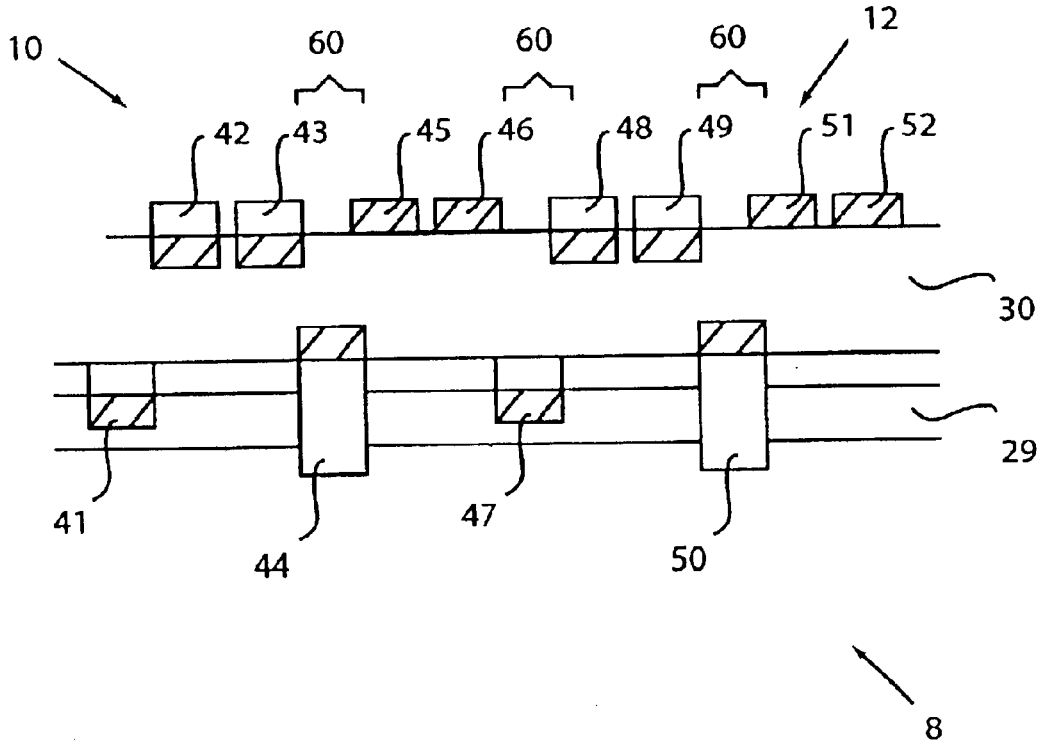
FIG. 4 is a cross-sectional view taken in the weftwise direction as indicated by line 4—4 in FIG. 1.

Returning now to FIG. 1, MD yarns 41–52, which are warp yarns in the process by which the fabric is woven, may be flat monofilament yarns having cross sections of substantially rectangular shape. The cross-sectional shape of MD yarns 41–52 is shown in FIG. 4, a cross-sectional view taken in the weftwise direction as indicted by line 4—4 in FIG. 1.

MD yarns 41–52 are arranged in groups of three in which two MD yarns arc twinned and weave as one with the CD yarns 21–32. Specifically, MD yarns 42,43; MD yarns 45,46; MD yarns 48,49; and MD yarns 51,52 are twinned pairs, which are separated from those adjacent thereto by MD yarns 41,44,47,50. These latter MD yarns 41,44,47,50 define continuous air channels 60 on the surface 12 of the fabric 10 in a manner to be described below.

The twinned MD yarn pairs form long floats on the surface 12 of the fabric 10. Specifically, MD yarns 42,43 weave under CD yarns 21 and 22, over CD yarns 23–31, and under CD yarns 32 in each repeat of the weave pattern, whereby MD yarns 42,43 float over four consecutive CD yarns 24,26,28,30 of the second layer 16 on the surface 12 of the fabric 10. MD yarns 48,49 weave in the same manner as MD yarns 42,43.

Similarly, MD yarns 45,46 weave over CD yarns 21–25, under CD yarns 26–28, and over CD yarns 29–32 in each repeat of the weave pattern, whereby MD yarns 45,46 float over four consecutive CD yarns 30,32,22,24 of the second layer 16 on the surface 12 of the fabric 10. MD yarns 51,52 weave in the same manner as MD yarns 45,46. The floats formed by MD yarns 45,46 and MD yarns 51,52 are offset in the machine direction from those formed by MD yarns 42,43 and MD yarns 48,49 by six CD yarns.

MD yarns 41,44,47,50, which separate the twinned MD yarn pairs from one another, weave over three CD yarns and under the following three CD yarns in a repeating pattern. Specifically, MD yarns 41,47 weave over CD yarns 21,22, 23, under CD yarns 24,25,26, over CD yarns 27,28,29, and under CD yarns 30,31,32 in each repeat of the weave pattern. On the other hand, MD yarns 44,50 weave over CD yarn 21, under CD yarns 22,23,24, over CD yarns 25,26,27, under CD yarns 28,29,30, and over CD yarns 31,32. As such, MD yarns 44,50 weave with the CD yarns in a manner that is offset in the machine direction from the manner in which MD yarns 41,47 so interweave by two CD yarns.

With particular reference to FIGS. 1 and 3, it will be noted that MD yarn 41, and MD yarn 47 which weaves in the same manner, does not have a long float on the surface 12 of fabric 10. Instead, MD yarns 41,47 weave over only CD yarns 22,28 of the second layer 16, and tend to pull CD yarns 22, 28 inwardly with respect to the surface 12, so that the knuckles formed by MD yarns 41,47 when weaving with CD yarns 22,28 are inward of the floats formed by MD yarns 42,43; 45,46; 48,49; and 50,51. As a consequence, MD yarns 41,47 are protected from heat and abrasion on the surface 12 of the fabric 10.

Similarly, MD yarn 44, and MD yarn 50 which weaves in the same manner, also does not have a long float on the surface 12 of fabric 10. Instead, MD yarns 44,50 weave over only CD yarns 26,32 of the second layer 16, and tend to pull CD yarns 26,32 inwardly with respect to the surface 12, so that the knuckles formed by MD yarns 44,50 when weaving with CD yarns 26,32 are also inward of the floats formed by MD yarns 42,43; 45,46; 48,49; and 50,51. As a consequence, MD yarns 44,50 are also protected from heat and abrasion on the surface 12 of the fabric 10.

Because the knuckles formed when MD yarns 41,47 weave over CD yarns 22,28, and when MD yarns 44,50 weave over CD yarns 26,32 are inward of the long floats formed by MD yarns 42,43; 45,46; 48,49; 50,51, MD yarns 41,44,47,50 define continuous air channels 60 between these twinned pairs. Continuous air channels 60 provide a solution to the problem of "drop-off" in dryer sections such as single-run dryer sections. Continuous air channels 60, which are oriented in the machine direction, perform the same function as is carried out by grooved dryer rolls and cylinders. That is, they provide volume for air carried into and trapped in a compression wedge, thereby reducing the tendency for air to be forced through the fabric 10 entirely, where it may cause "drop off". The void volume provided by continuous air channels 60 is different from that in other dryer fabric structures, both woven and spiral-link, because the void volume is continuous. Most dryer fabrics have some void volume, but generally the void volume is provided in discrete discontinuous pores or openings in the fabric. In the present invention, the void volume is continuous in a predetermined direction, such as in the machine direction.

Figure 2:
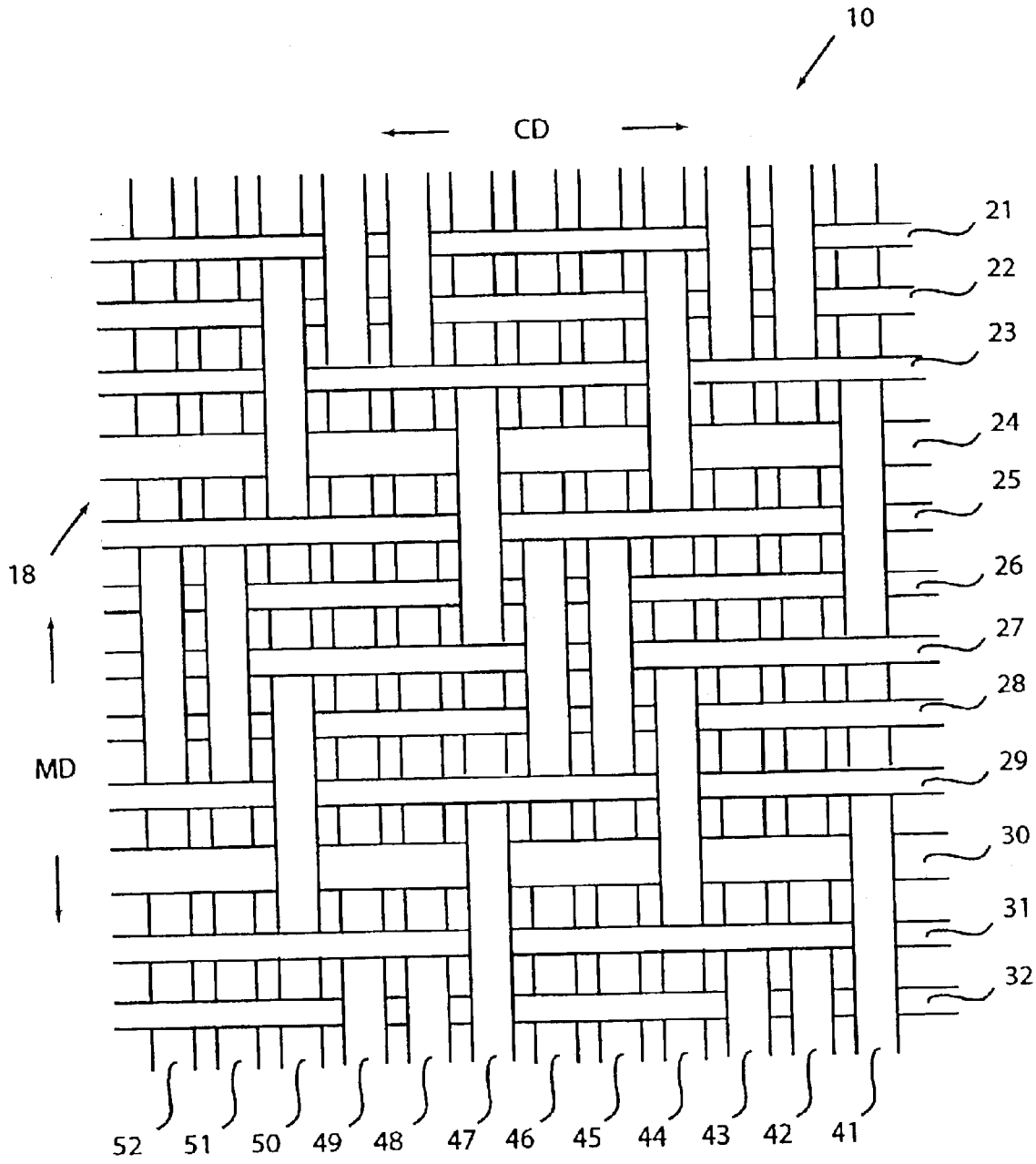
FIG. 2 is a plan view of another surface of the papermaker's fabric of FIG. 1.

FIG. 2 is a plan view of surface 18 of the fabric 10, and is the reverse of FIG. 1. FIGS. 2 and 3A taken together show that MD yarns 41–52 bind with a single CD yarn 21,23,25, 27,29,31 of the first layer 14 each lime they weave to the first layer 14. Specifically, MD yarns 41,47 bind with CD yarns 25,31 as they weave to the first layer 14 twice in each repeat of the weave pattern. Similarly, MD yarns 44,50 bind with CD yarns 23,29 as they weave to the first layer 14 twice in each repeat of the weave pattern. On the other hand, the twinned pairs of MD yarns 42,43; 48,49 bind with CD yarn 21 as they weave to the first layer 14 once in each repeat of the weave pattern, while the twinned pairs of MD yarns 45,46; 51,52 bind with CD yarn 27 as they weave to the first layer 14 once in each repeat of the weave pattern. As a consequence, CD yarns 21,23,25,27,29,31 make up most of the area of the surface 18 of the fabric, which surface 18 may appropriately be described as a shute-runner surface. In reality, CD yarns 22,24,26,28,30,32 of the second layer 16 may barely be visible on the surface 18 of the actual fabric 10 as the spacing between the yarns is quite small. In any event, the CD yarn-dominated nature of the surface 18 of the fabric 10 protects MD yarns 41–52 from heat and abrasion.

As an alternative to the arrangement previously described, the CD and MD yarns could be arranged so as to form a so-called monoplane surface wherein the CD and MD yarns both form the paper-contacting surface. Such monoplane surface arrangement would not affect the air channels.

Figure 3B:
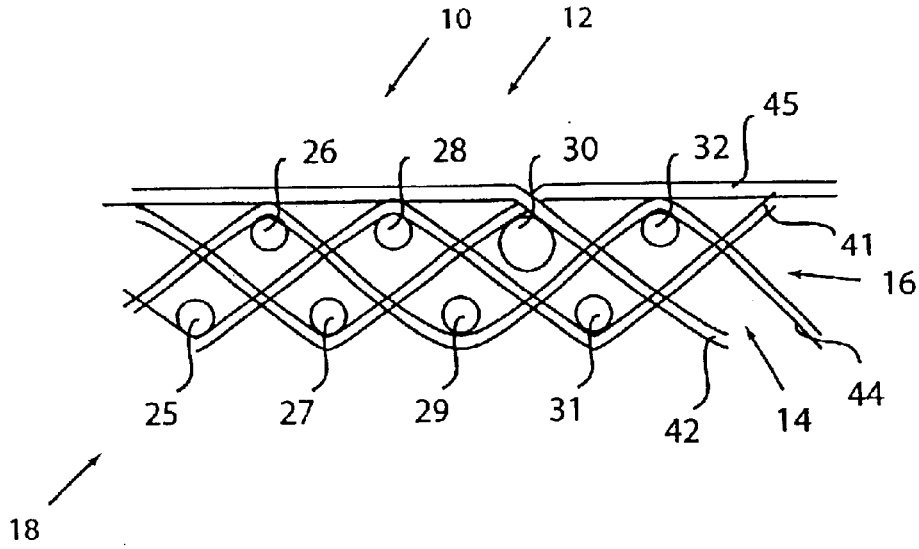
FIG. 3B is a cross-sectional view of a papermaker's fabric according to another embodiment of the present invention.

The fabric 10 preferably comprises only monofilament yarns. Specifically, the CD yarns may be anticontaminant polyester monofilament. Such anticontaminant may be more deformable than standard polyester and, as a result, may more easily enable the fabric to be woven so as to have a relatively low permeability (such as 100 CFM) as compared to the more non-deformable yarns. The CD yarns may have a circular cross-sectional shape with one or more different diameters. For example, CD yarns 24,30 may have a diameter of 0.90 mm while CD yarns 21–23, 25–29,31,32 may have a diameter of 0.50 mm or 0.60 mm. That is, CD yarns 24,30 may be of larger diameter than the other CD yarns 21–23, 25–29, 31,32 as suggested in FIGS. 1, 2, 3A, and 4. As twinned pairs of MD yarns 42,43; 45,46; 48,49; and 51,52 weave over CD yarns 24,30 when weaving up from or down to CD yarns 21,27 in the first layer 14, the larger diameter of CD yarns 24,30 provides additional depth to the continuous air channels 60. Alternatively, and as shown in FIG. 3B, all of the CD yarns (i.e. CD yarns 21–32) may each have the same diameter such as 0.80 mm. The MD yarns 41–52 may be flat monofilament yarns of substantially rectangular cross-sectional shape. For example, the MD yarns 41–52 may have substantially rectangular cross sections which measure 0.44 mm by 0.88 mm, the longer dimension lying parallel to the plane of the surface 12 as shown in FIG. 4.

The fabric 10 may be woven in a 6-harness repeat arrangement. Alternately, the fabric 10 may be woven in other harness repeat arrangements. For example, it may be woven in a 4-harness repeat arrangement.

Further, in addition to a circular cross-sectional shape, one or more of the CD yarns may have other cross-sectional shapes such as a rectangular cross-sectional shape or a non-round cross-sectional shape. As previously indicated, MD yarns 41–52 may be flat monofilament yarns of substantially rectangular cross-sectional shape. Alternatively, any or all of such MD yarns may have other cross-sectional shapes such as a circular cross-sectional shape or a non-round cross-sectional shape.

In the above 4-harness repeat example, single MD yarns having a relatively large width may be used in place of the twinned pairs of MD yarns.

Figure 6:
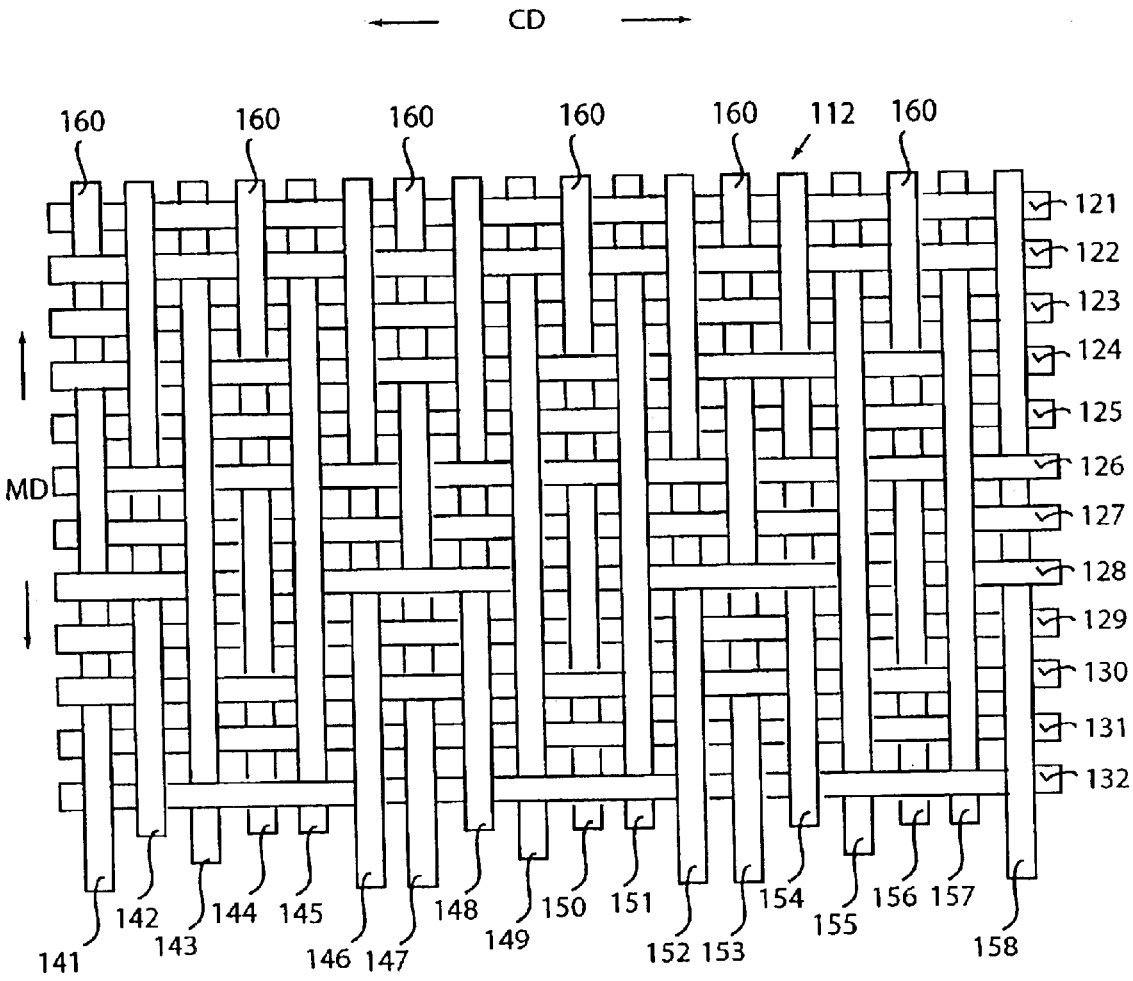
FIG. 6 is a plan view of a surface of a papermaker's fabric according to another embodiment of the present invention.

As a further alternate, a fabric 100 may be fabricated without any twinned pairs of MD yarns. An example of such arrangement is illustrated in FIG. 6 which is a plan view of a surface 112 of the papermaker's fabric 100 according to another embodiment of the present invention. The paper side of the papermaker's fabric 100 may be smoother than that of fabric 10. In FIG. 6, the machine direction (MD) and cross-machine direction (CD) may be as indicated. The spacing between the yarns of the papermaker's fabric 100 in this and other figures is exaggerated for the sake of clarity. FIG. 6 shows three repeats of the weave pattern side by side one another.

MD yarns 141–158 are arranged in groups of six in which no two MD yarns are arranged as a twinned pair as in the embodiment of FIG. 1. Irregardless, one or more of MD yarns 141,144,147,150,153, and 156 may define continuous air channels 160 on the surface 112 of the fabric 100 in a manner to be described below.

MD yarns 142,143, 145,146,148,149,151,152,154,155, 157 and 158 form long floats on the surface 112 of the fabric 100. More specifically, MD yarn 142 weaves over CD yarns 121–125, under CD yarns 126–128, and over CD yarns 129–132 in each repeat of the weave pattern, whereby MD yarn 142 floats over four CD yarns 122,124,130,132 of the second layer 116 on the surface 112 of the fabric 100. MD yarns 146,148,152,154,158 weave in the same manner as MD yarn 142. MD yarn 143 weaves under CD yarn 121-122, over CD yarns 123-131, and under CD yarn 132 in each repeat of the weave pattern, whereby MD yarn 143 floats over four consecutive CD yarns 124,126,128,130 of the second layer 116 on the surface 112 of the fabric 100. MD yarns 145,149,151,155,157 weave in the same manner as MD yarn 143. The floats formed by MD yarns 142, 146, 148,152,154,158 are offset in the machine direction from those formed by MD yarns 143, 145,149,151,155,157 by six CD yarns.

MD yarns 141,147,153 weave over CD yarn 121, under CD yarns 122–124, over CD yarns 125–127, under CD yarns 128–130, and over CD yarns 131–132 in each repeat of the weave pattern. On the other hand, MD yarns 144, 150,156 weave over CD yarns 121–123, under CD yarns 124–126, over CD yarns 127–129, and under CD yarns 130–132. As such, MD yarns 141,147, 153 weave with the CD yarns in a manner that is offset in the machine direction from the manner in which MD yarns 144,150,156 so interweave by two CD yarns.

Figure 7:
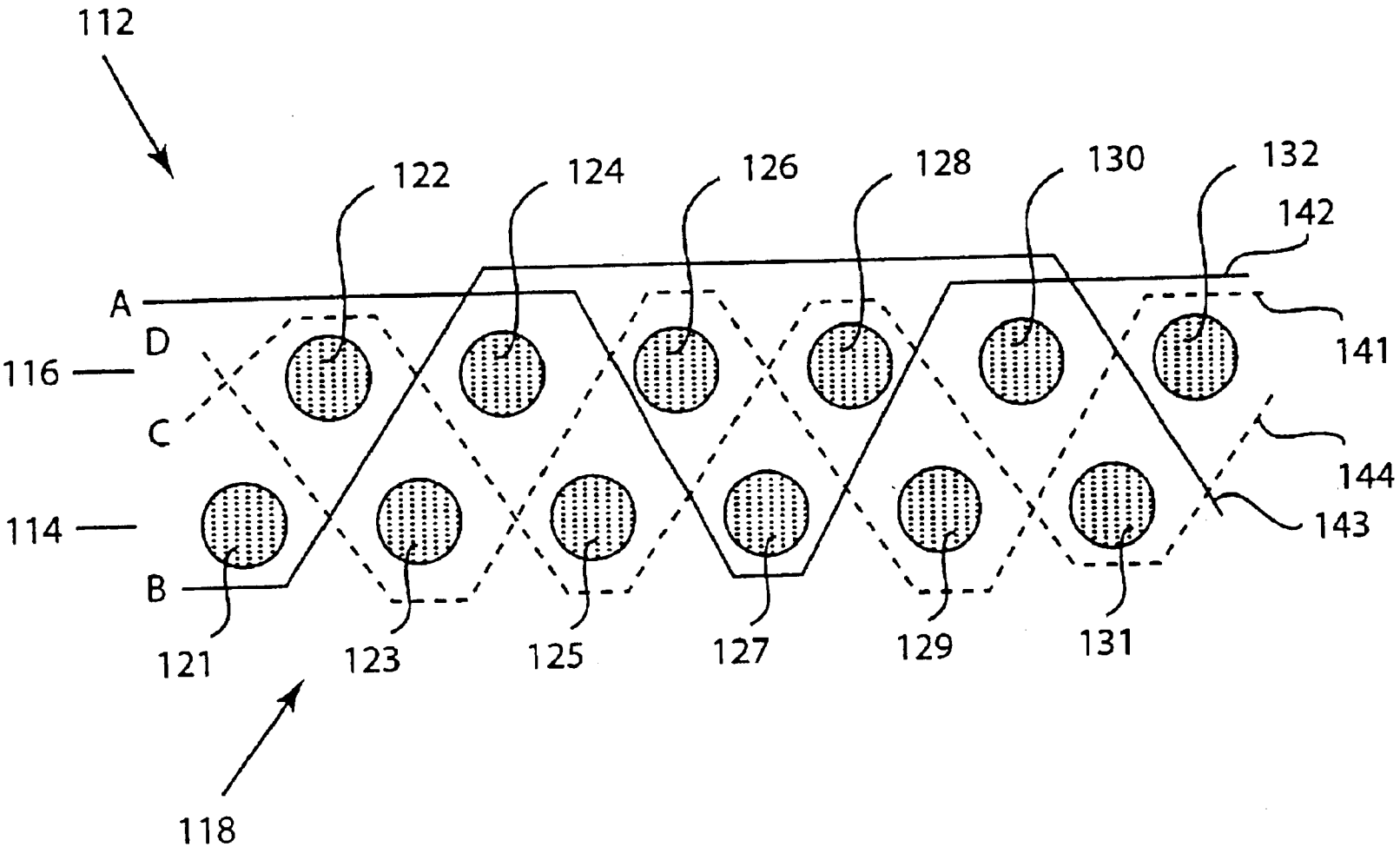
FIG. 7 is a cross-sectional view of the papermaker's fabric of FIG. 6.
Figure 8:
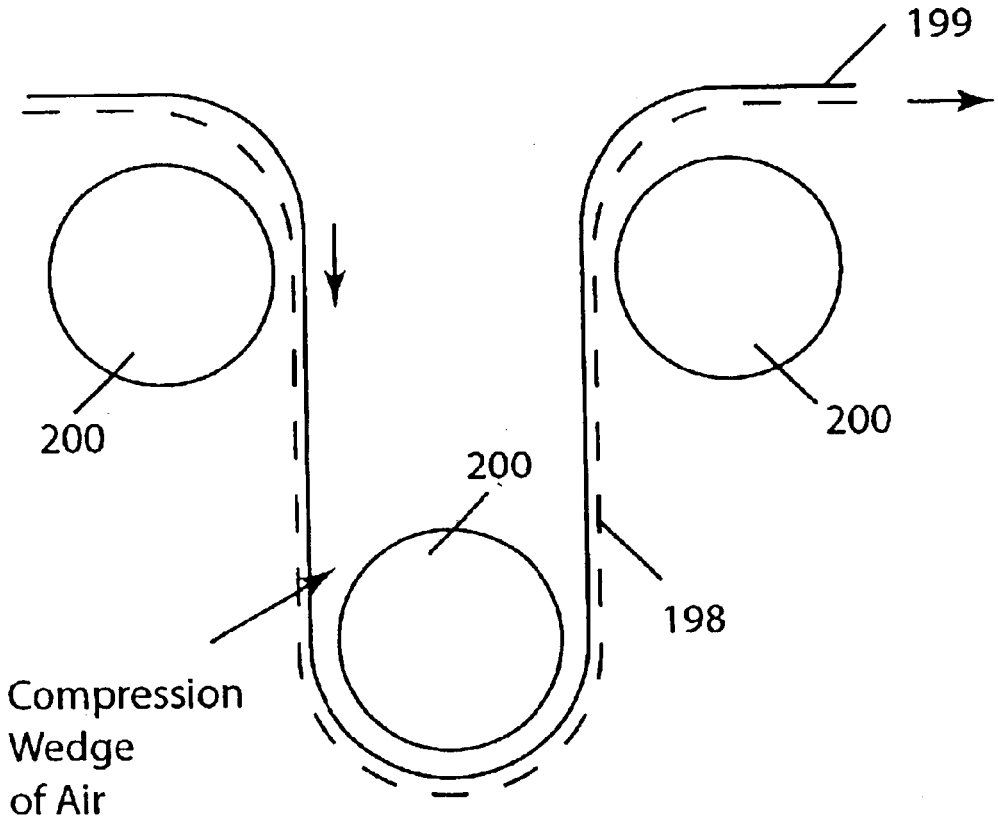
FIG. 8 is a cross-sectional view of a single-run dryer section.

With reference to FIGS. 6 and 7, MD yarns 141,147, 153 do not have a long float on the surface 112 of fabric 100. Instead, MD yarns 141,147, 153 weave over only CD yarns 126,132 of the second layer 116, and tend to pull CD yarns 126,132 inwardly with respect to the surface 112, so that the knuckles formed by MD yarns 141,147, 153 when weaving with CD yarns 126,132 are inward of the floats formed by MD yarns 142, 143,145, 146,148,149,151,152,154,155,

157,158. As a consequence, MD yarns 141,147,153 are protected from heat and abrasion on the surface 112 of the fabric 100.

Similarly, MD yarns 144,150,156 also do not have a long float on the surface 112 of fabric 100. Instead, MD yarns 144,150,156 weave over only CD yarns 122,128 of the second layer 116, and tend to pull CD yarns 122,128 inwardly with respect to the surface 112, so that the knuckles formed by MD yarns 144,150,156 when weaving with CD yarns 122,128 are also inward of the floats formed by MD yarns 142, 143,145, 146,148,149,151,152,154,155, 157,158. As a consequence, MD yarns 144,150,156 are also protected from heat and abrasion on the surface 112 of the fabric 100.

The knuckles formed when MD yarns 141,147,153 weave over CD yarns 126,132 and when MD yarns 144,150,156 weave over CD yarns 122,128 are inward of the long floats formed by MD yarns 142, 143,145, 146,148,149,151,152, 154,155, 157,158. As a result, MD yarns 141,144,147,150, 153,156 may define continuous air channels 160 there between. Such continuous air channels 160 are oriented in the machine direction and may perform in a manner similar to air channels 60.

MD yarns 141–158 bind with the CD yarns of the first layer 114 each time they weave to the first layer. Specifically, MD yarns 141,147,153 bind twice with CD yarns in the first layer 114 in each repeat of the weave pattern, that is, these MD yarns bind with CD yarns 123,129 in each repeat of the weave pattern. Similarly, MD yarns 144,150,156 bind twice with CD yarns in the first layer 114 in each repeat of the weave pattern, that is, these MD yarns bind with CD yarns 125,131 in each repeat of the weave pattern. On the other hand, MD yarns 142,146, 148,152,154,158 bind once with CD yarns in the first layer 114 in each repeat of the weave pattern, that is, these MD yarns bind with CD yarn 127 in each repeat of the weave pattern, and MD yarns 143,145, 149,151,155,157 bind once with CD yarns in the first layer 114 in each repeat of the weave pattern, that is, these MD yarns bind with CD yarn 121 in each repeat of the weave pattern. As a consequence, CD yarns 121,123,125,127,129, 131 make up most of the area of the surface 118 of the fabric 100. CD yarns 122,124,126,128,130,132 of the second layer 116 may barely be visible on the surface 118 of the actual fabric 100 as the spacing between the yarns is quite small. In any event, the CD yarns of the surface 118 of the fabric 100 may protect the MD yarns from heat and abrasion.

Yarns used in the fabric 100 may be monofilament-type yarns, such as anticontaminant polyester monofilament yarns. As previously described, such anticontaminant may be more deformable than standard polyester and the woven fabrics may have a relatively low permeability (such as 100 CFM). Additionally, some or all of the CD yarns 121–132 may have a rectangular cross-sectional shape or a non-round cross-sectional shape or a circular cross-sectional shape with one or more different diameters, such as in a manner similar to that previously described with regard to fabric 10. Furthermore, some or all of the MD yarns 141–158 may have cross-sectional shapes such as a circular cross-sectional shape or a non-round cross-sectional shape or may be flat monofilament yarns having substantially rectangular cross-sectional shape, such as in a manner similar to that previously described with regard to fabric 10.

Therefore, CD yarns 21–32 and 121–132 may be monofilament yarns of any of the synthetic polymeric resins used in the production of such yarns for paper machine clothing. Polyester and polyamide are but two examples of such materials. Other examples of such materials are polyphenylene sulfide (PPS), which is commercially available under the name RYTON®, and a modified heat-, hydrolysis- and contaminant-resistant polyester of the variety disclosed in commonly assigned U.S. Pat. No. 5,169,499, and used in dryer fabrics sold by Albany International Corp. under the trademark THERMONETICS®. The teachings of U.S. Pat. No. 5,169,499 are incorporated herein by reference. Further, such materials as poly (cyclohexanedimethylene terephthalate-isophthalate) (PCTA), polyetheretherketone (PEEK) and others could also be used. Furthermore, one or more of the CD yarns may have a circular, rectangular or other cross-sectional shapes.

As previously indicated, MD yarns 41–52 and 141–158 may be flat monofilament yarns of substantially rectangular cross-sectional shape. Alternatively, any or all of such MD yarns may have other cross-sectional shapes. Additionally, MD yarns 41–52 and 141–158 may be any of the synthetic polymeric resins used in the production of yarns for paper machine clothing. Polyester and polyamide are but two examples, along with the other materials disclosed above.

Figure 5:
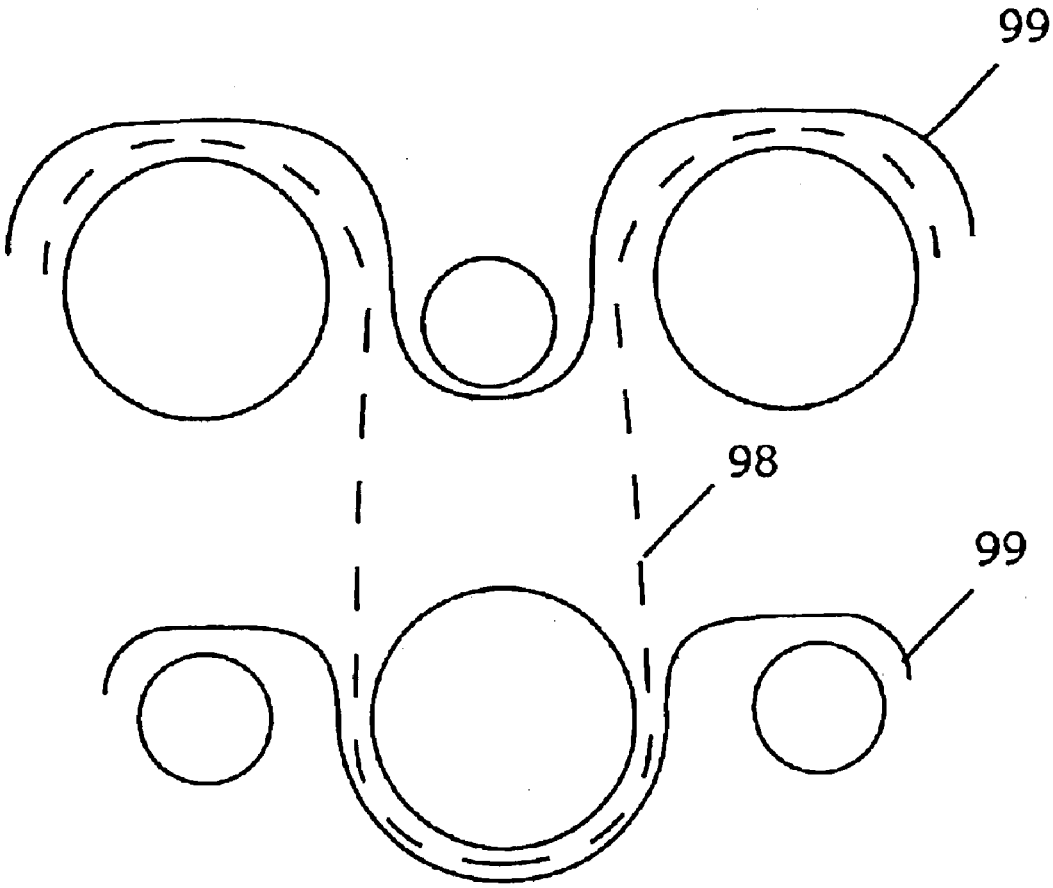
FIG. 5 is a cross-sectional view of a dryer section.

The fabric 10 and/or 100 may be used with a single run or single tier dryer section. Alternatively, the fabric 10 and/or 100 may be used with other types of dryer sections, such as that shown in FIG. 5. As is to be appreciated, in such situation, fabrics 99 would be replaced with fabrics 10 or 100.

Further, as previously described, the fabric 10 and the fabric 100 each have a number of air channels. The number of air channels in the fabric 10 per unit length may be the same as or different from that in the fabric 100.

Furthermore, the surface having the air channels may be smoother than the non-air channel surface; whereas, the non-air channel surface may provide a better grip than the air-channel surface. As a result, it may be desirable to have the air-channel surface face the paper in some circumstances and to have the non-air channel surface face the paper in other circumstances. Therefore, during operation, the fabric 10 and/or fabric 100 may be arranged such that either side thereof may face the paper sheet. That is, surface 12 or surface 18 of the fabric 10 may face the paper sheet, and surface 112 or surface 118 of the fabric 100 may face the paper sheet.

Additionally, the MD yarns and the CD yarns may be interwoven such that the MD and CD yarn knuckles lie in substantially the same plane. Such arrangement may provide a relatively smooth surface. Alternatively, the MD yarns and the CD yarns may be interwoven such that the CD yarn knuckles lie in a plane higher (or closer to the surface) than that of the MD knuckles. This arrangement protects the MD yarns.

Although in the above embodiments the fabrics were described as having two CD layers, certain number of repeat patterns, certain length of the MD floats, certain offset values, and so forth, the present invention is not so limited. That is, the present fabrics may have more than two CD layers, may have different number of repeat patterns, may have different length MD floats, and different offset values.

Further, although in the above embodiments the fabrics were described as having air channels on one surface thereof, the present invention is not so limited. That is, the present fabrics may have air channels on either surface or on two surfaces. For example, the present fabric may have three CD yarn layers with MD yarns interwoven therewith so as to have air channels on both a paper-contacting surface and a non-paper-contacting surface. In such situation, the arrangement of air channels on the paper-contacting surface may be the same or different than that on the non-paper-contacting surface.

Modifications to the above would be obvious to those of ordinary skill in the art, but would not bring the invention so modified beyond the scope of the present invention. For example, while fabric 10 and 100 may be flat-woven and joined into endless form for use on the dryer section of a paper machine, it is also possible to produce the fabric 10 and/or 100 by endless weaving, in which case the MD yarns 41–52 and/or 141–158 would be weft yarns during the weaving process and the CD yarns 21–32 and/or 121–132 would be warp yarns. The claims to follow should be construed to cover such a situation.

What is claimed is:

1. A papermaker's fabric comprising:

a first layer and a Second layer of cross-machine direction (CD) yarns; and a plurality of machine-direction (MD) yarns arranged in groups each having a first MD yarn and two second MD yarns;

wherein said first MD yarn in each group is interwoven with said CD yarns of said first and second layers in a duplex weave, said first MD yarn binding with two CD yarns of said first layer and with two CD yarns of said second layer when interweaving therewith within a repeat pattern;

wherein said second MD yarns in each said group are also interwoven with said CD yarns of said first and second layers in a duplex weave, said second MD yarns binding with only one CD yarn of said first layer when interweaving therewith and floating over at least two consecutive CD yarns of said second layer when interweaving therewith within said repeat pattern; and wherein said first MD yarn in each said group is between said two second MD yarns thereof, whereby a continuous air channel is formed by said first MD yarn between said second MD yarns in each said group.

2. The papermaker's fabric as in claim 1 wherein said second MD yarns in each said group float over four consecutive CD yarns of said second layer when interweaving therewith within said repeat pattern.

3. The papermaker's fabric as in claim 1 wherein at least some of said MD yarns are flat monofilament yarns of substantially rectangular cross-sectional shape.

4. The papermaker's fabric as in claim 1 wherein at least some of said MD yarns are flat monofilament yarns having non-round cross-sectional shape.

5. The papermaker's fabric as in claim 1 wherein at least some of said MD yarns are one of polyamide yarns, polyester yarns, polyphenylene sulfide yarns, modified heat-, hydrolysis- and contaminant-resistant polyester yarns, poly (cyclohexanedimethylene terephthalateisophthalate) yarns, and polyetheretherketone yarns.

6. The papermaker's fabric as in claim 1 wherein at least some of said CD yarns are monofilament yarns having one of a circular cross-sectional shape and a rectangular cross-sectional shape.

7. The papermaker's fabric as in claim 1 wherein at least some of said CD yarns are monofilament yarns having a non-round cross-sectional shape.

8. The papermaker's fabric as in claim 6 wherein some of said CD yarns have the circular cross-sectional shape with a first diameter and some of said CD yarns have the circular cross-sectional shape with a second diameter which is different from said first diameter.

9. The papermaker's fabric as in claim 6 wherein at least some of said CD yarns are one of polyamide yarns, polyester yarns, polyphenylene sulfide yarns, modified heat-, hydrolysis- and contaminant-resistant polyester yarns, poly (cyclohexanedimethylene terephthalateisophthalate) yarns, and polyetheretherketone yarns.

10. The papermaker's fabric as in claim 1 wherein said CD yarns of said first layer are offset in the machine direction relative to said CD yarns of said second layer so as not to be in vertically stacked positions relative thereto.

11. A papermaker's fabric comprising:

a first layer and a second layer of cross-machine direction (CD) yarns; and a plurality of machine-direction (MD) yarns arranged in groups each having a first MD yarn, two second MD yarns, and two third MD yarns;

wherein said first MD yarn in each group is interwoven with said CD yarns of said first and second layers in a duplex weave, said first MD yarn binding with two CD yarns of said first layer and with two CD yarns of said second layer when interweaving therewith within a repeat pattern;

wherein said second MD yarns in each said group are interwoven with said CD yarns of said first and second layers in a duplex weave, said second MD yarns binding with only one CD yarn of said first layer when interweaving therewith and floating over at least two consecutive CD yarns of said second layer when interweaving therewith within said repeat pattern;

wherein said third MD yarns in each said group are interwoven with said CD yarns of said first and second layers in a duplex weave, said third MD yarns binding with only one CD yarn of said first layer when interweaving therewith and floating over at least two consecutive CD yarns of said second layer when interweaving therewith within said repeat pattern;

wherein said second MD yarns are offset from said third MD yarns in a direction parallel to the MD yarns; and wherein said first MD yarn is between said two second MD yarns which are between said third MD yarns in each said group, whereby a continuous air channel is formed in each said group by said first MD yarn between said second MD yarns.

12. The papermaker's fabric as in claim 11 wherein each said group further includes a fourth MD yarn wherein said fourth MD yarn in each said group is interwoven with said CD yarns of said first and second layers in a duplex weave such that said fourth MD yarn binds with two CD yarns of said first layer and with two CD yarns of said second layer when interweaving therewith within a repeat pattern, and wherein said fourth MD yarn is offset from said first MD yarn in the direction parallel to the MD yarns, and wherein said fourth MD yarn in each said group is between one of said third MD yarns thereof and one of the third MD yarns of an adjacent group, whereby a second continuous air channel is formed in each said group by said fourth MD yarn between one of said third MD yarns in the respective group and one of the third MD yarns of the adjacent group.

13. The papermaker's fabric as in claim 12 wherein said second MD yarns in each said group float over four consecutive CD yarns of said second layer when interweaving therewith within said repeat pattern.

14. The papermaker's fabric as in claim 12 wherein said third MD yarns in each said group float over four CD yarns of said second layer when interweaving therewith within said repeat pattern.

15. The papermaker's fabric as in claim 12 wherein at least some of said MD yarns are flat monofilament yarns of substantially rectangular cross-sectional shape.

16. The papermaker's fabric as in claim 12 wherein at least some of said MD yarns are flat monofilament yarns having non-round cross-sectional shape.

17. The papermaker's fabric as in claim 12 wherein at least some of said MD yarns are one of polyamide yarns, polyester yarns, polyphenylene sulfide yarns, modified heat-, hydrolysis- and contaminant-resistant polyester yarns, poly(cyclohexanedimethylene terephthalateisophthalate) yarns, and polyetheretherketone yarns.

18. The papermaker's fabric as in claim 12 wherein at least some of said CD yarns are monofilament yarns having one of a circular cross-sectional shape and a rectangular cross-sectional shape.

19. The papermaker's fabric as in claim 12 wherein at least some of said CD yarns are monofilament yarns having non-round cross-sectional shape.

20. The papermaker's fabric as claimed in claim 18 wherein some of said CD yarns have the circular cross-sectional shape with a first diameter and some of said CD yarns have the circular cross-sectional shape with a second diameter which is different from said first diameter.

21. The papermaker's fabric as in claim 12 wherein at least some of said CD yarns are one of polyamide yarns, polyester yarns, polyphenylene sulfide yarns, modified heat-, hydrolysis- and contaminant-resistant polyester yarns, poly(cyclohexanedimethylene terephthalateisophthalate) yarns, and polyetheretherketone yarns.

22. Thc papermaker's fabric as in claim 12 wherein said CD yarns of said first layer are offset in the machine direction relative to said CD yarns of said second layer so as not to be in vertically stacked positions relative thereto.

* * * * *